United States Patent [19]

Abbin, Jr. et al.

[11] 4,345,124

[45] Aug. 17, 1982

[54] ACCELERATION SWITCH

[75] Inventors: Joseph P. Abbin, Jr., Albuquerque; Howard F. Devaney, Cedar Crest; Lewis W. Hake, Albuquerque, all of N. Mex.

[73] Assignee: The United States of America as represented by the United States Department of Energy, Washington, D.C.

[21] Appl. No.: 70,545

[22] Filed: Aug. 29, 1979

[51] Int. Cl.[3] ..... H01H 35/14

[52] U.S. Cl. ..... 200/61.53; 200/61.45 R; 73/492; 73/514; 102/253; 102/262

[58] Field of Search ..... 200/61.45 R, 61.45 M, 200/61.53; 73/492, 514; 102/252, 253, 262

[56] References Cited

U.S. PATENT DOCUMENTS

| | | | |
|---|---|---|---|
| 3,072,760 | 1/1963 | Hazen | 200/61.53 X |
| 3,096,411 | 7/1963 | Chabrek et al. | 200/61.53 |
| 3,137,175 | 6/1964 | Jamgochian | 200/61.53 X |
| 3,693,461 | 9/1972 | Daffron | 73/514 |
| 4,266,107 | 5/1981 | Abbin, Jr. et al. | 200/61.53 |

*Primary Examiner*—J. V. Truhe
*Assistant Examiner*—Eugene S. Indyk
*Attorney, Agent, or Firm*—George H. Libman; Dudley W. King; James E. Denny

[57] ABSTRACT

The disclosure relates to an improved integrating acceleration switch of the type having a mass suspended within a fluid filled chamber, with the motion of the mass initially opposed by a spring and subsequently not so opposed.

5 Claims, 9 Drawing Figures

ACCELERATION SWITCH

The U.S. Government has rights in this invention pursuant to Contract No. DE-AC04-76DP00789 between the U.S. Department of Energy and Western Electric Company, Inc.

This invention relates to an integrating acceleration-sensitive switch. In particular, the invention is a switch employing a movable mass opposed by a spring and damped by a fluid.

BACKGROUND OF THE INVENTION

Accelerometers, acceleration switches, and inertial sensing devices are widely used to measure accelerations (forces resulting from vibrations, changes in velocity, or the like). Such devices may include some sort of sensing mass suspended within the device so as to be affected by acceleration forces so as to move and thereby open or close an electrical contact. The acceleration switch may be filled with damping fluid so as to prevent premature actuation of the switch due to vibration, shocks, or the like.

One possible use for such an acceleration switch is in a rocket arming circuit. For reasons of safety, it may be desired that some circuits aboard the rocket or its payload not be actuated until the rocket has experienced a normal launch environment. For additional safety, it may also be desired that these circuits not be actuated when the rocket or its payload is involved in abnormal environments such as accidental fire or crash during transportation.

In a typical moving mass switch, damping fluid is provided to prevent actuation upon application of a short hi-g force which, typically, would be caused by accidentally dropping the switch onto a hard surface. In addition, if the acceleration of the rocket is sufficient, the moving mass of the switch may be selected such that a launch acceleration over several seconds is sufficient to move the mass through the damping fluid and to overcome the friction of closing switch contacts. However, for certain rockets having a low-g launch profile and limited payload capacity, it has been found that the force associated with the relatively small mass moving through the damping fluid is not sufficient to overcome the friction of closing switch contacts.

SUMMARY OF THE INVENTION

In view of the difficulties and disadvantages as noted above, it is an object of this invention to provide a novel apparatus for measuring or sensing the forces and times associated with acceleration.

It is a further object of this invention to provide an acceleration switch which reliably actuates when subjected to a predetermined acceleration-time environment.

It is a still further object of this invention to provide an acceleration switch which is rugged enough to withstand high shock levels and yet be sensitive to the desired acceleration levels.

It is another object of this invention to provide an acceleration switch which releases a moving mass from the opposing force of a spring prior to contact closure.

It is still another object to this invention to provide an acceleration switch that is disabled from actuation in the event that it is subjected to fire prior to use.

The invention comprises an improved acceleration switch having a mass or piston suspended in a fluid filled case and biased against motion by a spring. Upon acceleration in the desired longitudinal direction, the mass tends to move to close several electrical contacts. After an initial portion of movement of the piston, the piston and spring are decoupled such that the spring force no longer opposes piston movement and the full force of acceleration is available for closing switch elements. In the event of a fire, the switch is prevented from closing by interposing a member in the path of the piston.

BRIEF DESCRIPTION OF THE DRAWINGS

Other objects and advantages of the present invention will be apparent to those skilled in the art from the following description with reference to the appended claims wherein like numbers denote like parts and wherein:

DESCRIPTION OF THE PREFERRED EMBODIMENT

Figure 1:
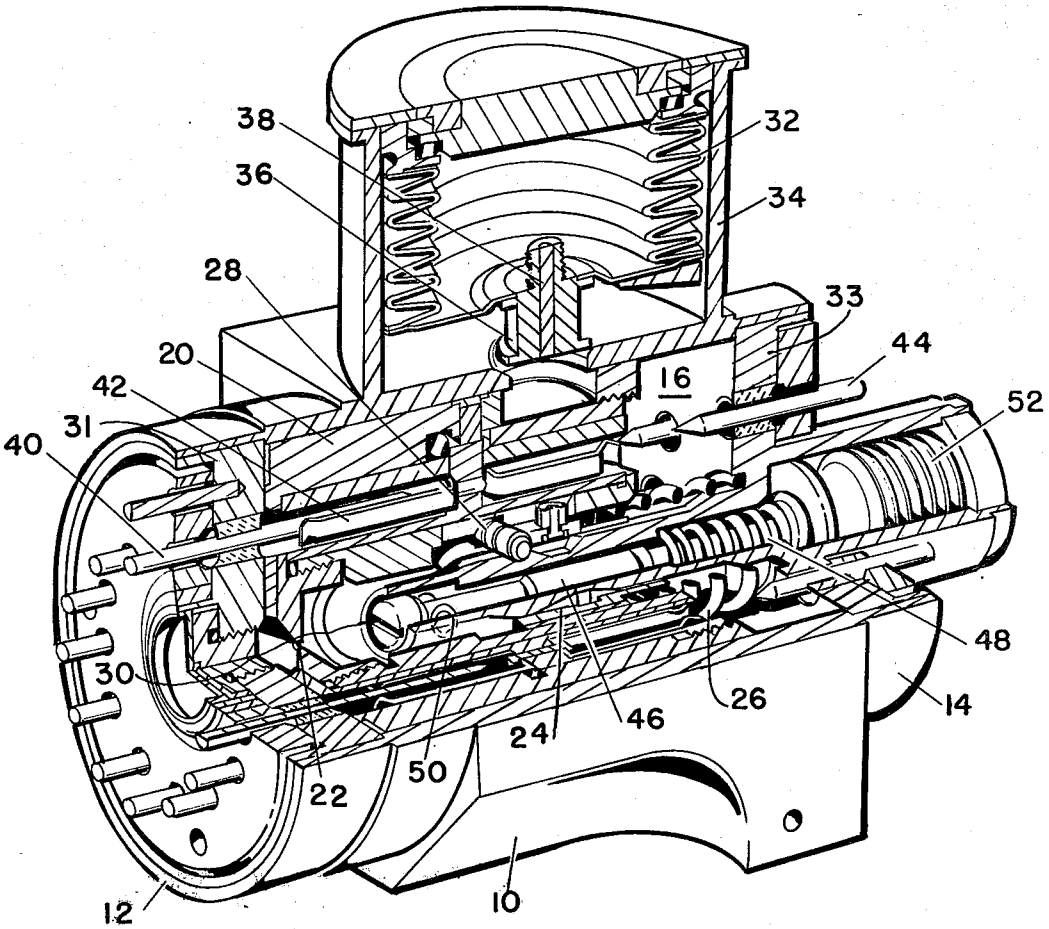
FIG. 1 illustrates in cutaway perspective an exemplary embodiment of the present invention.
Figure 2:
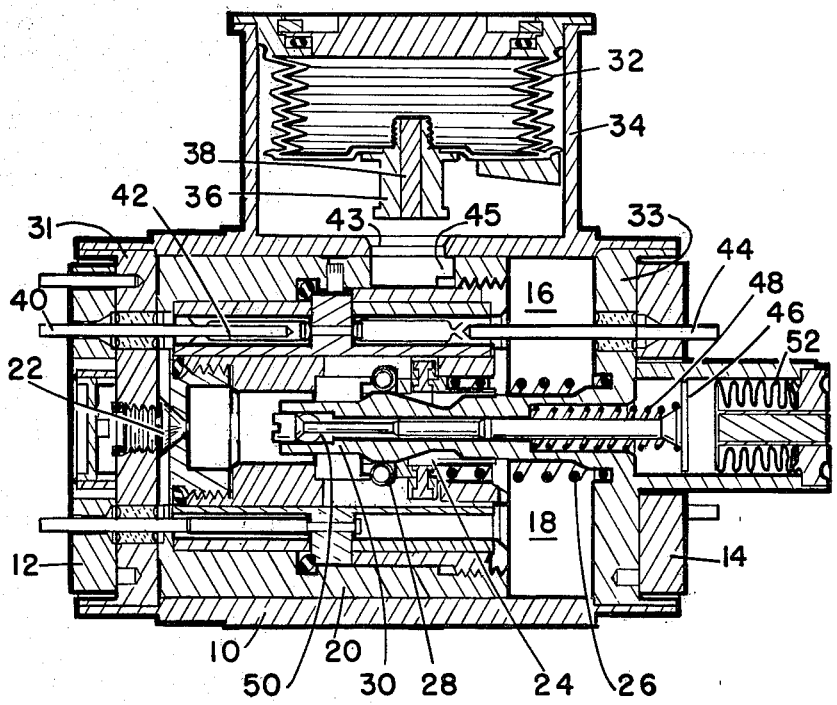
FIG. 2 illustrates in cross section an exemplary embodiment of the present invention.
Figure 3A:
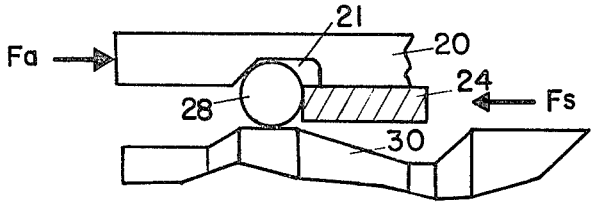
FIGS. 3*a* to 3*f* illustrate a portion of the operation of the present invention.
Figure 3B:
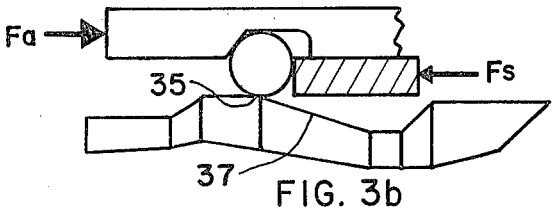
Figure 3C:
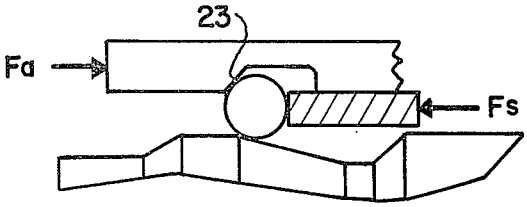
Figure 3D:
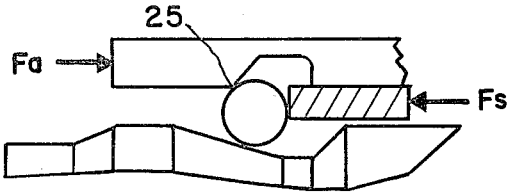
Figure 3E:
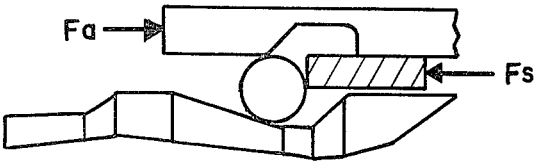
Figure 3F:
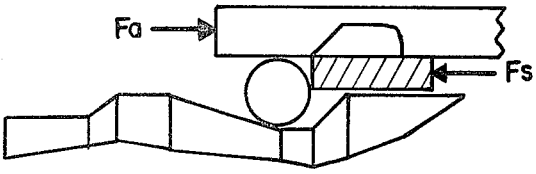

Reference is now made to FIGS. 1 and 2 which illustrate an exemplary embodiment of the invention. Described generally, the acceleration switch of the present invention is shown comprising a tubular housing 10 having a reset end 12 and an actuate end 14 and forming a chamber 16 filled with a silicone fluid 18. As shown in the preferred embodiment, housing 10 may comprise a combination of interlocked elements including opposed end caps 31, 33 and post 30, which is carried by or integral with end cap 33. Contained within the tubular housing is an inertial piston 20 which is longitudinally movable under acceleration or "set back" forces. Piston 20 is shown in the preferred embodiment to comprise a plurality of parts and to have a hollow center portion. The surface of the hollow center portion cooperates with the outer surface of post 30 through rollers 28 in a manner described hereinafter. This piston movement is opposed by bias spring 26 through collar 24 and rollers 28 and damped by the flow of fluid 18 through orifice 22.

As the acceleration or g-force increases above a preset minimum, (acceleration is toward the left in FIGS. 1 and 2), the piston 20 tends to move (toward the right) away from the reset end 12 towards the actuate end, compressing spring 26. When the piston moves sufficiently close to the actuate end, various electrical circuits are closed. The switching elements which close these circuits comprise input terminals 40 mounted through end cap 31 at reset end 12, output terminals 44 mounted through end cap 33 at actuate end 14, and sliding electrical contacts 42 carried by piston 20. The sliding electrical contacts 42 are in constant contact with the input terminals 40 and make contact with output terminals 44 as the piston approaches the actuate end.

It may be difficult to reliably close a large number of switch elements when the movement of an inertial piston is opposed by a spring and also opposed by significant friction forces involved with sliding contacts, particularly during the camming or ramping action when contact "make" occurs. For this reason, the force generated by spring 26 is not transmitted directly to piston 20, but is transmitted through collar 24 and a pair of opposed rollers 28 (only one roller is shown in FIG. 1, both rollers are shown in FIG. 2). It will be understood that to minimize friction with the post, collar and piston, each roller may actually be a plurality of rollers on a common axle.

During the initial movement of piston 20, the spring force acts on the collar 24 which bears against which are rollers 28 positioned by the surface of post 30 to engage surface of the hollow center portion of the internal groove 21 in the piston, thus coupling the piston with the spring. During the latter portion of the movement of the piston, a reduction in diameter of post 30 allows rollers 28 to disengage from piston 20, thus decoupling the piston from the spring.

Figure 4:
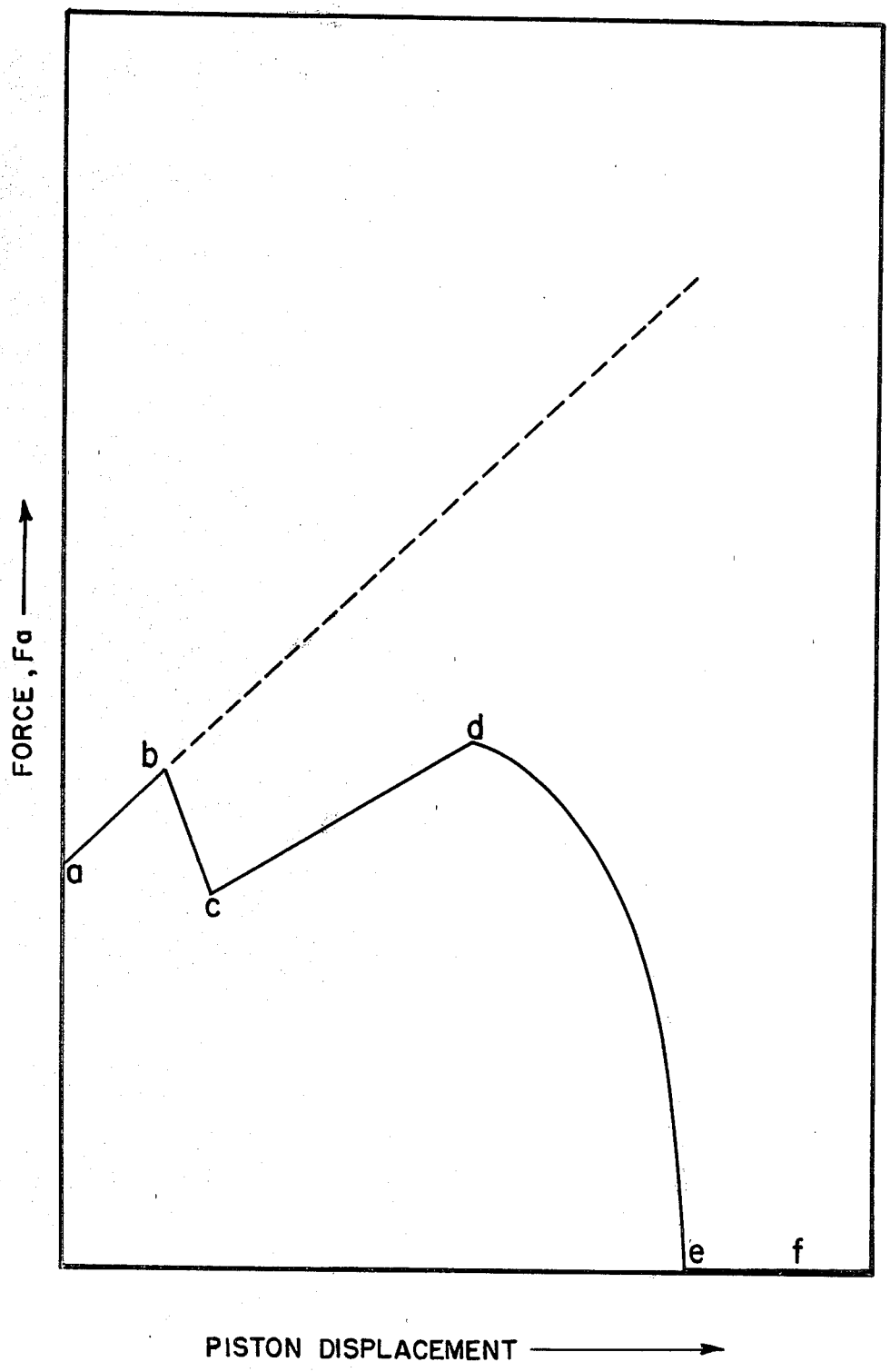
FIG. 4 graphically illustrates the acceleration v. spring force characteristics of an exemplary embodiment of the present invention.

This action may be more clearly understood by referring to FIGS. 3*a* to 3*f* and 4. FIGS. 3*a* to 3*f* illustrate the relative positions of the inertial piston 20, collar 24, rollers 28, and post 30 during piston travel. Acceleration acting on the piston results in a force tending to move piston 20 to the right, while spring force Fa, as transmitted through collar 24 and rollers 28, opposes this motion. As shown in FIGS. 3*a* to 3*f*, Fa is the minimum value of force acting to the right on piston 20 required to balance the transmitted spring force acting to the left. For movement to occur, the acceleration force must exceed the sum of Fa and other forces due to friction and fluid damping. FIG. 4 shows the values for Fs for the various positions of the piston a, b, c, etc.

At position a, or rest, and for movement from a to b, the full amount of spring force Fa is transmitted to the piston except for rolling friction between the rollers and post. The slope of the line from a to b in FIG. 4 is the spring constant of spring 26. As the piston moves from position b to position c, roller 28 rolls around the obtuse angle or corner 35 on the post and just starts to move down the shallow ramp 37 of the post. This roll-off is accompanied by an abrupt decrease in force (as shown in FIG. 4, point c) because the post begins to assume a portion of the spring force through rollers 28 and ramp 37. During piston stroke between points c and d, roller 28 is engaged by two sloping surfaces simultaneously: the shallow ramp 37 of the post and the left sloping side 23 of internal groove 21 in the piston. The degree of the slope on these two surfaces determines the portion of the spring force which is directed into the post, and consequently the effective spring constant of the spring 26 over this portion of piston travel. FIG. 4 shows that the slope of the curve in this region c to d is less than the slope in region a to b, although the force continues to increase as a result of the increased compression of spring 26. At position d, the roller, having reached the end of the sloping surface of the piston groove 21, begins to roll around exit corner 25 the groove causing the force to decrease. At position e, this roll-off is completed and the force drops to near zero. The full force of the spring is now directed through roller 28 into post 30, leaving piston 20 free to continue motion to point e opposed only by friction forces. The design is such that the electrical contacts will close after Fa is significantly reduced (beyond position d).

Once the piston has traveled the length of the housing and closed the electrical circuits, it is latched closed by latching balls 50. These balls are urged into recesses in the piston by latching rod 46 which is biased by latching spring 48. The switch may be reset by manually pressing reset bellows 52 to extend latching rod 46, allowing latching balls 50 to unseat from the recess in the piston.

In order to prevent the acceleration switch from becoming susceptible to actuation in the event damping fluid is lost (as in an accidental fire), the switch is provided with a safety mechanism mounted on the side of the tubular housing. This mechanism comprises a gas-filled bellows 32 contained in an exterior bellows housing 34 with a safety detent 36 carried at one end of the bellows. The safety detent 36 is sealed with a plug or core 38 of low melting point alloy. In the event the switch becomes overheated, such as in a fire, the low melting alloy core melts, allowing fluid 18 to leak from chamber 16 into the interior of the bellows. This allows the bellows, which had been under compression, to expand and move safety detent 36 through an aperture 43 in housing 10 and into an adjacent recess 45 in the piston. The piston is thereby blocked from moving and the switch will not actuate.

The exemplary embodiment is about 2.5 inches long and 1.3 inches wide with a volume of about 4 cubic inches and a weight of about 1 pound. The switch will not operate (close electrical contacts) if it experiences an acceleration of 3 g or less with a velocity change of 40 g-seconds or less. The switch will not operate when subjected to high mechanical shock (20,000 g, 0.5 ms), crush (27,000 lbs longitudinal & 52,000 lbs transverse) or high temperature (250° to 1000° F.) or if it loses damping fluid for any reason. It will operate at accelerations above about 4½ g provided the velocity change exceeds about 90 g-seconds.

The various features and advantages of the invention are thought to be clear from the foregoing description. However, various other features and advantages not specifically enumerated will undoubtedly occur to those versed in the art, as likewise will many variations and modifications of the preferred embodiment illustrated, all of which may be achieved without departing from the spirit and scope of the invention as defined in the following claims.

We claim:

1. An acceleration actuated switch comprising: a generally tubular housing including end portions forming a chamber; a fixed electrical contact within said chamber; a post carried by an end portion and projecting into the chamber, said post having a portion of reduced diameter connected by a tapering portion with a more remote larger diameter portion; a movable mass having a recess therein normally disposed opposite said larger diameter portion of said post; a spring and damping fluid within said chamber, said spring normally maintaining said mass in an initial position, said mass being movable during acceleration along said post toward said fixed electrical contact in opposition to said spring and with transfer of damping fluid past said mass during said movement; a roller contacting said post and projecting into said recess; a collar for transmitting force between said spring and roller; a surface of said recess moving said roller from said larger diameter portion along said taper towards said smaller diameter portion during movement of said mass resulting in decreased rate of opposition by said spring against said mass.

2. The acceleration actuated switch of claim 1 wherein said collar is concentric with said post and wherein said collar transmits force from said spring to said roller.

3. The acceleration actuated switch of claim 1 wherein said movable mass has a central aperture concentric with said post and a side aperture; and said tubular housing has a wall aperture adjacent said side aperture when said mass is in the initial position, and an exterior housing enclosing said wall aperture.

4. The acceleration actuated switch of claim 3 further comprising: piston motion blocking means for movement from a first position where said means does not intersect both said side aperture in said mass and said adjacent aperture in said housing, to a second position where said means does intersect both said apertures; and fusible plug means connected to said blocking means for effecting leaking of said fluid from said chamber upon exposure to an elevated temperature, thereby causing said blocking means to move from said first position to said second position.

5. The acceleration actuated switch of claim 2 wherein said movable mass carries an electrical element aligned with said fixed electrical contact and has a central aperture concentric with said post; said roller comprises opposed rollers; said recess is an internal groove in said aperture having a sloping surface for effecting translation of said rollers; said rollers, said groove and the reduced diameter of said post being sized so that said rollers are free of said groove when at the reduced diameter, thereby releasing the movement of said mass from opposition of the force of said spring before said mass touches said electrical contact.

* * * * *